US006472629B2

(12) United States Patent
Dufournet

(10) Patent No.: US 6,472,629 B2
(45) Date of Patent: Oct. 29, 2002

(54) PUFFER SWITCH HAVING A TWO-VOLUME BREAK CHAMBER

(75) Inventor: Denis Dufournet, Sathonay-Camp (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/835,389

(22) Filed: Apr. 17, 2001

(65) Prior Publication Data

US 2001/0035395 A1 Nov. 1, 2001

(30) Foreign Application Priority Data

Apr. 19, 2000 (FR) ..... 00 05041

(51) Int. Cl.[7] ..... H01H 33/70
(52) U.S. Cl. ..... 218/53; 218/54; 218/43
(58) Field of Search ..... 218/51, 53, 54, 218/57, 59, 61–66, 72–73, 88, 141

(56) References Cited

U.S. PATENT DOCUMENTS

| | | | | |
|---|---|---|---|---|
| 3,975,602 A | * | 2/1975 | Hertz et al. | 218/61 |
| 4,239,949 A | | 12/1980 | Kii et al. | |
| 4,270,034 A | | 5/1981 | Kii | |
| 4,459,447 A | | 7/1984 | Arimoto | |
| 4,471,188 A | | 9/1984 | Van et al. | |

FOREIGN PATENT DOCUMENTS

| | | | |
|---|---|---|---|
| EP | 0 150 079 | 7/1985 | H01H/33/98 |
| EP | 0 248 677 | 12/1987 | H01H/33/98 |
| FR | 2 385 209 | 10/1978 | H01H/33/74 |
| FR | 2 385 212 | 10/1978 | H01H/33/74 |
| FR | 2 520 551 | 7/1983 | H01H/33/94 |
| FR | 2 520 928 | 8/1983 | H01H/33/915 |

OTHER PUBLICATIONS

European Search Report dated Jan. 9, 2001.

* cited by examiner

*Primary Examiner*—Lincoln Donovan
*Assistant Examiner*—M. Fishman
(74) *Attorney, Agent, or Firm*—Sughrue Mion, PLLC

(57) ABSTRACT

An electric switch includes a first arcing contact surrounded by a puffer break chamber in which the gas is pressurized by the thermal effect, and a second arcing contact movable along an axial direction relative to the first arcing contact. The break chamber includes an inner partition separating a first compartment of fixed volume from a second compartment of smaller volume, both compartments being filled with the gas under pressure and each possessing an orifice to blast the arc, the orifices being separate and placed in series along the axial direction. Each compartment is connected to its own orifice via a respective blast channel. The compartments communicate with each other via a channel that is closed by an excess pressure vent device allowing gas at excess pressure to pass in one direction only from the smaller volume compartment to the larger volume compartment.

7 Claims, 1 Drawing Sheet

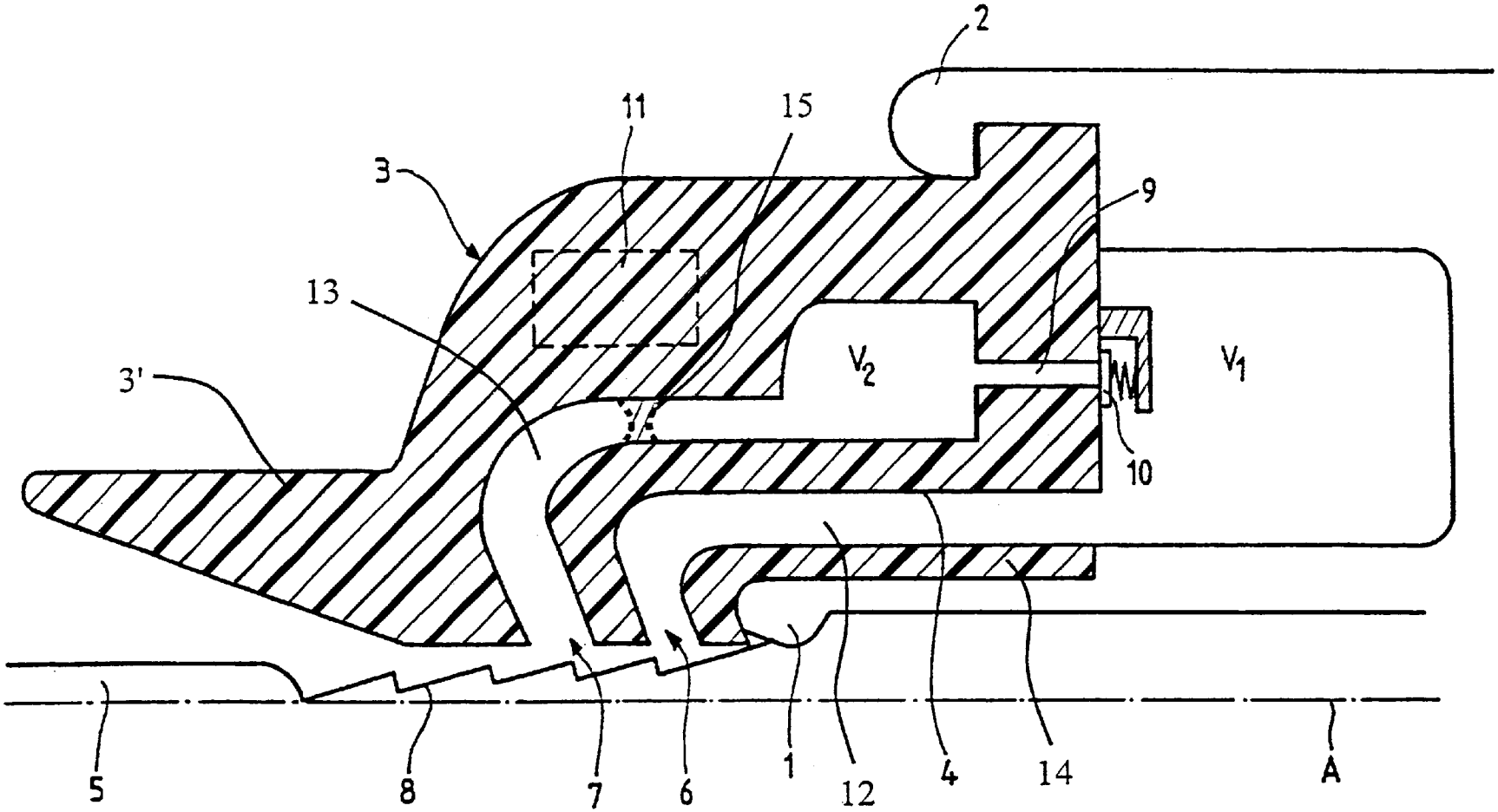
2
9
10
$V_1$
$V_2$
15
11
3
13
3'
14
4
12
1
6
7
8
5
A

PUFFER SWITCH HAVING A TWO-VOLUME BREAK CHAMBER

FIELD OF THE INVENTION

The invention relates to an electric switch, in particular for medium or high-voltage, the switch comprising a first arcing contact surrounded by a puffer break chamber in which gas is pressurized by the thermal effect, and a second arcing contact movable in an axial direction relative to the first contact. The break chamber has an internal partition separating a first compartment of fixed volume from a second compartment of smaller volume, both compartments being filled with said gas under pressure and each possessing an orifice for blasting the arc. The orifices are separate and disposed in series along said axial direction, and the second arcing contact is arranged initially to release the orifice of the first compartment while still closing the orifice of the second compartment during separation of the two contacts.

OBJECT AND SUMMARY OF THE INVENTION

The object of the invention is to propose such a switch which, by puffer action, is capable of breaking short-circuit currents that are low (i.e. currents of up to 30% of the break power of the switch), and also currents that are high, while using drive energy that is as small as possible.

To this end, the invention provides such as switch, wherein each compartment is connected to its own orifice via a respective blast channel, wherein the first compartment with its blast channel and its orifice are placed adjacent to said first arcing contact, wherein the second compartment is placed mainly between the ends of the first arcing contact and a permanent-current contact corresponding thereto, and wherein the compartments communicate with each other via a channel that is closed by an excess pressure vent device allowing gas at excess pressure to pass in one direction only from the smaller volume compartment to the larger volume compartment.

The larger-volume compartment is optimized to break higher currents, i.e. currents greater than 30% of the break power of the switch. The smaller-volume compartment is optimized to break smaller currents. With this disposition having two thermal volumes, the switch can break currents over the entire break range of the switch by puffer means.

In a particular embodiment of the puffer switch of the invention, the switch has a nozzle of insulating material placed coaxially around the first contact with the second arcing contact penetrating therein, at least the second of the two compartments being placed inside said nozzle, the inner partition which separates the two compartments being formed by a portion of the nozzle. In a variant of this particular embodiment, the blast channel of the first compartment is separated from the first arcing contact by a wall surrounding said contact and made of the same insulating material as the nozzle. Spacers can be placed in the blast channel of the second compartment and secured to the inner partition which separates the two compartments and also to the main body of the nozzle. In an additional variant, a permanent magnet producing a turning magnetic field for interrupting the electric arc is placed inside the nozzle or indeed inside the second arcing contact.

BRIEF DESCRIPTION OF THE DRAWING

Other characteristics and advantages of the switch of the invention will appear on reading the following description of an embodiment illustrated in the sole FIGURE which is a diagrammatic axial half section view of a puffer circuit breaker.

MORE DETAILED DESCRIPTION

In the FIGURE, a puffer circuit breaker of the invention is shown in part and diagrammatically in a axial half section. It comprises a first arcing contact 1 secured to a permanent-current contact 2. The arcing contact 1 is surrounded coaxially by a nozzle 3 made of electrically insulating material, and represented by shading. The nozzle 3 has a compartment of fixed volume V2 disposed mainly between the ends of the permanent-current contact 2 and the first arcing contact 1, in which volume the dielectric gas is pressurized by the thermal effect. Another compartment of greater volume V1 is disposed between the coaxial tubes formed by the arcing and permanent-current contacts 1 and 2, adjacent to the volume V2 and also adjacent to the first arcing contact 1 and remote from the blast cone 3' of the nozzle 3. A break chamber having two distinct volumes is thus provided. The compartment of greater volume V1 is referred to below as the first compartment, while the compartment of smaller volume V2 is referred to as the second compartment. These two compartments are separated by an inner partition 4. In the preferred embodiment of the break chamber as shown, the inner partition 4 is formed by a portion of the nozzle 3 which is constituted by the inner tubular wall of said nozzle. Preferably, only the second compartment is located inside the nozzle, thereby limiting the size of the nozzle and thus the cost thereof. Nevertheless, without going beyond the ambit of the invention, it is possible to provide a nozzle 3 that is extended away from its blast cone 3' to surround the volume V1 in full or in part.

The circuit breaker has a second arcing contact 5 which is movable in the axial direction A relative to the arcing contact 1 and which penetrates inside the nozzle 3 when the circuit breaker is in the closed position. The second arcing contact 5 is likewise secured to a corresponding permanent-current contact (not shown in FIGURE). The second arcing contact 5 in this case is in the form of a rod and it is inserted in the first arcing contact 1 which is hollow.

When the circuit breaker is opened and an electric arc such as 8 is struck between the first and second arcing contacts 1 and 5, the thermal effect produces an increase in the pressure of the dielectric gas inside both of the compartments of the break chamber. On passing through current zero, the gas under pressure in the first and second compartments is blown onto the arc through the first and second blast orifices 6 and 7. Each blast orifice 6 or 7 of a compartment is connected to the compartment via a blast channel 12 or 13 formed in the nozzle 3 or along an internal wall thereof. In the preferred embodiment as shown, the blast channel 12 from the first compartment is separated from the arcing first contact 1 by a wall 14 surrounding said arcing contact and made of the same insulating material as the nozzle 3.

Spacers 15 can be placed in the blast channel 13 from the second compartment and secured to the inner partition 4 and also to the main body of the nozzle 3 in order to increase the mechanical strength of the nozzle against the increased pressure in the second compartment.

The volume V1 of the first compartment is dimensioned so as to obtain the pressure rise necessary for breaking high currents. This volume V1 must therefore be large enough to avoid the gas it contains overheating. The volume V2 is smaller than the volume V1, e.g. 0.25 to 0.35 times V1, thus making it possible to obtain the pressure rise required for breaking low current short-circuits. The two compartments communicate with each other via a channel 9 which is closed by a device 10 for venting excess pressure that allows gas to flow in one direction only from the second compartment of smaller volume V2 to the first compartment having the larger volume V1 in the event of the pressure in the second compartment becoming excessive. The vent device 10 shown in the figure is a rated valve.

The two blast orifices 6 and 7 are placed in series in the direction A, the first orifice 6 being situated between the arcing contact 1 and the second orifice 7. This disposition makes it possible, while the circuit breaker is opening, to apply blast along the electric arc 8 over two distinct portions of the arc. With this structure, for currents of intermediate magnitude, the blast from both orifices 6 and 7 is summed.

When breaking low currents, only the blast from the smaller volume V2 contributes effectively to extinguishing the arc. When breaking high currents, only the blast coming from the larger volume V1 contributes effectively to extinguishing the arc.

Operation of the switch is optimum when the orifice 6 of the larger volume compartment V1 is situated adjacent to the first arcing contact 1. While the first and second arcing contacts 1 and 5 are separating, the second arcing contact 5 uncovers the orifice 6 first on being withdrawn from the contact 1 in the direction A, thereby enabling the gas from the first compartment to begin blowing about the arc while the orifice 7 from the second compartment is still closed by the second arcing contact 5. This arrangement makes it possible for the pressure of the gas in the first compartment to rise quickly, and it makes it possible to limit the volume of gas that needs to be heated by the electric arc solely to the volume of V1 because the rated valve 10 then remains closed.

With low currents, the extra pressure in the second compartment remains low and the valve 10 thus remains closed, such that the volume that is pressurized remains equal to the smaller volume V2. With very high currents, the extra pressure in the second compartment is limited by the rated valve 10 opening, thus allowing some of the gas in the second compartment to pass into the first compartment. A rapid rise in the pressure of the gas in the first compartment thus makes it possible to achieve fast breaking with an electric arc of short length. If necessary, the electric arc can be blasted a second time via the orifice 7 if the electric arc is of greater length.

The rated valve 10 makes it possible to avoid overheating and excess pressure in the gas in the second compartment because this gas can escape into the first compartment, with its temperature falling as it expands into the volume V1.

For very low currents, the arc might not be lengthened sufficiently to obtain a clean break of the arc by the puffer effect. Under such circumstances, it is advantageous to provide at least one permanent magnet 11, e.g. inside the nozzle 3 or inside the moving arcing contact 5, so as to establish a turning magnetic field that stretches the electric arc by causing it to rotate and thus make it easier to extinguish.

The structure of the break chamber of the invention with the two orifices 6 and 7 placed in series along the direction A makes it possible to obtain a high pressure blast of gas that is directed towards one root of the arc and another blast of gas which is directed towards the other root of the arc. This dual blast is particularly useful in breaking line faults.

The circuit breaker of the invention requires about half the drive energy required for driving a circuit breaker having a break chamber with a single volume only and provided with a compression piston.

What is claimed is:

1. An electric switch comprising a first arcing contact surrounded by a puffer break chamber in which a gas is pressurized by a thermal effect, and a second arcing contact movable along an axial direction relative to the first arcing contact, said break chamber including an inner partition separating a first compartment of fixed volume from a second compartment of smaller volume, both compartments being filled with said gas under pressure and each possessing an orifice to blast the arc, said orifices being separate and placed in series along said axial direction, the second arcing contact initially releasing the orifice of the first compartment while still closing the orifice of the second compartment when the arcing contacts separate, wherein each compartment is connected to its own orifice via a respective blast channel, wherein the first compartment with its blast channel and its orifice are placed adjacent to said first arcing contact, wherein the second compartment is placed mainly between the ends of the first arcing contact and a permanent-current contact corresponding thereto, and wherein the compartments communicate with each other via a channel that is closed by an excess pressure vent device allowing gas at excess pressure to pass in one direction only from the smaller volume compartment to the larger volume compartment.

2. The switch of claim 1, in which the volume of the second compartment lies in the range 0.25 to 0.35 times the volume of the first compartment.

3. The switch of claim 1, in which a nozzle of insulating material is placed coaxially around the first contact and in which at least the second of the two compartments is disposed inside said nozzle, the inner partition separating these two compartments being formed by a portion of the nozzle.

4. The switch of claim 3, in which the blast channel of the first compartment is separated from the first arcing contact by a wall surrounding said first arcing contact and made of the same insulating material as the nozzle.

5. The switch of claim 3, in which spacers are placed in the blast channel of the second compartment and are secured to the inner partition and also to a main body of the nozzle.

6. The switch of claim 3, in which a permanent magnet producing a magnetic field for interrupting the electric arc is placed inside the nozzle.

7. The switch of claim 1, in which a permanent magnet producing a magnetic field for interrupting the electric arc is disposed inside the second arcing contact.

* * * * *